United States Patent [19]

Takakura

[11] Patent Number: 4,941,801

[45] Date of Patent: Jul. 17, 1990

[54] DOUBLE WATER PUMP DEVICE

[75] Inventor: Yoshinari Takakura, Anjo, Japan

[73] Assignee: Aisin Seiki Kabushiki Kaisha, Kariya, Japan

[21] Appl. No.: 327,697

[22] Filed: Mar. 23, 1989

[30] Foreign Application Priority Data

Mar. 23, 1988 [JP] Japan ..... 63-037825[U]

[51] Int. Cl.[5] ..... F01D 15/00

[52] U.S. Cl. ..... 415/170.1; 415/173.5

[58] Field of Search ..... 415/97, 98, 93, 170.1, 415/173.1, 173.6, 173.5, 174.5, 143

[56] References Cited

U.S. PATENT DOCUMENTS

| | | | |
|---|---|---|---|
| 890,819 | 6/1908 | Thomson | 415/174.5 |
| 1,482,602 | 2/1924 | Coninck | 415/173.1 |
| 1,743,348 | 1/1930 | Hollander | 415/98 |
| 1,831,242 | 11/1931 | Hanzlik | 415/174.5 |
| 2,063,194 | 12/1936 | Roy | 415/143 |
| 2,944,785 | 7/1960 | Sampietro | 415/170.1 |
| 3,045,427 | 7/1962 | Baize et al. | 415/174.5 |
| 3,740,162 | 6/1973 | Tuomaala | 415/98 |
| 3,867,060 | 2/1975 | Huber | 415/173.5 |

FOREIGN PATENT DOCUMENTS

| | | | |
|---|---|---|---|
| 2587411 | 3/1987 | Fed. Rep. of Germany | 415/101 |

*Primary Examiner*—Robert E. Garrett
*Assistant Examiner*—Hoang Nguyen
*Attorney, Agent, or Firm*—Oblon, Spivak, McClelland, Maier & Neustadt

[57] ABSTRACT

A water pump device includes a pump housing within which is rotatably mounted a pump shaft having a rotor mounted thereon. An annular partition wall is mounted on the housing and extends into the housing so as to form a planar extension of the rotor. The rotor and partition wall define first and second substantially independent pump chambers in the housing. Two sets of impellers are mounted on the rotor, one set of the impellers extending into each of the chambers. Liquid inlet and discharge conduits communicate with each of the chambers so that a double pump is formed in the housing.

5 Claims, 2 Drawing Sheets

DOUBLE WATER PUMP DEVICE

BACKGROUND OF THE INVENTION

1. Field of the Invention:

This invention relates to water pump devices and more particularly to water pump devices which include double impellers for use in two independent water cooling systems for internal combustion engines.

2. Background of the Related Art:

In a conventional water pump device as shown in FIG. 2 and disclosed in, for example, Japanese Utility Model Laid Open No. 59-142493, a pump housing 20 has an intermediate plate 21 to thereby define independent first and second chambers 22 and 23. A pump shaft 24 which is rotatably supported in the housing 20 extends through the intermediate plate 21. A pair of pump impellers 25 and 26 are mounted on the shaft 24 and are positioned within the chambers 22 and 23, respectively. Disposed between the intermediate plate 21 and the shaft 24 is a seal member 27.

In the above prior art, two pump impellers 25 and 26 are formed independently so that the construction of the pump device becomes complex. Furthermore, since the seal member 27 is formed as contact type seal, the loss of pump torque increases due to the sliding resistance at the contact portion between the seal member 27 and the shaft 24. This results in a decrease in pump efficiency.

SUMMARY OF THE INVENTION

Therefore, it is an object of the present invention to provide a new and improved water pump device which obviates the above mentioned prior art drawbacks.

It is another object of the present invention to provide a new and improved water pump device which is simple in construction.

It is still another object of the present invention to provide a new and improved water pump device which does not reduce the pump efficiency.

According to the present invention, the above and other objects are achieved by a water pump device including a pump housing within which is rotatably mounted a pump shaft having a rotor mounted thereon. An annular partition wall is mounted on the housing and extends into the housing so as to form a planar extension of the rotor, whereby the rotor and partition wall define first and second substantially independent pump chambers in the housing. Two sets of impellers are mounted on the rotor, one set of the impellers extending into each of the chambers. Liquid inlet and discharge means communicate with each of the chambers so that a double pump is formed in the housing. An inner diameter of the partition wall is greater than an outer diameter of the rotor at any axial plane including the partition wall and the rotor, whereby the partition wall may be fitted on the rotor in the axial direction.

BRIEF DESCRIPTION OF THE DRAWINGS

Various other objects, features and attendant advantages of the present invention will be more fully appreciated as the same becomes better understood from the following detailed description when considered in connection with the accompanying drawings wherein.

DETAILED DESCRIPTION OF THE PREFERRED EMBODIMENTS

Figure 1:
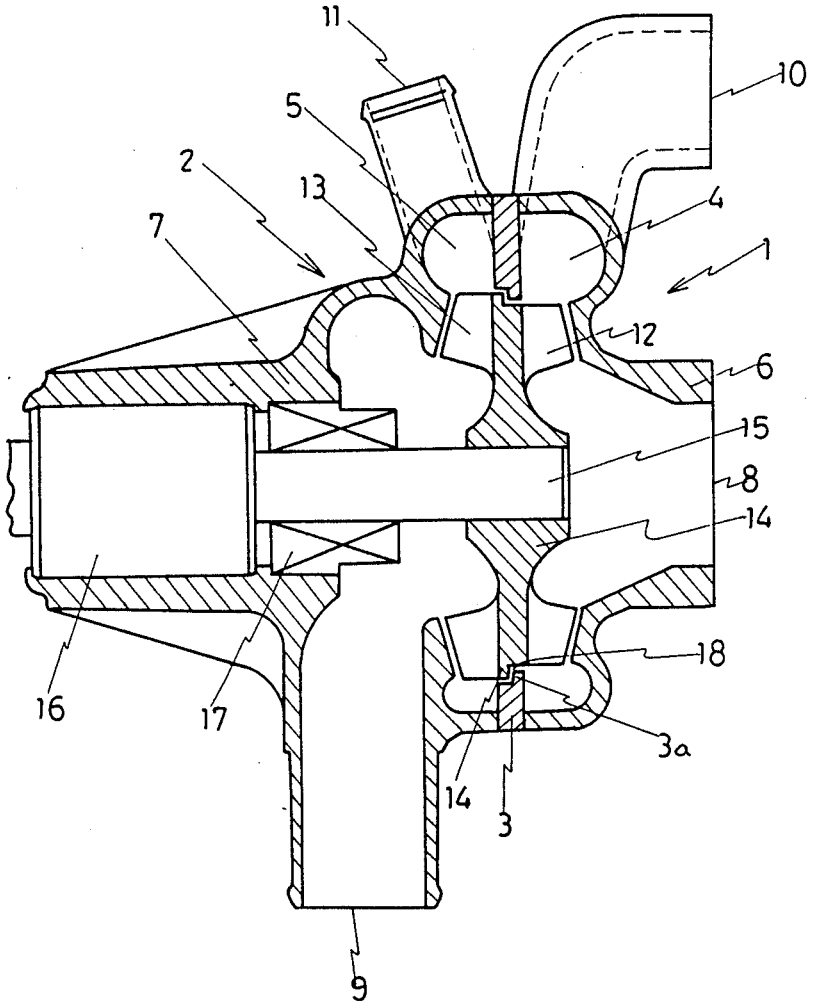
FIG. 1 is a cross sectional view of the water pump device according to the present invention.
Figure 2:
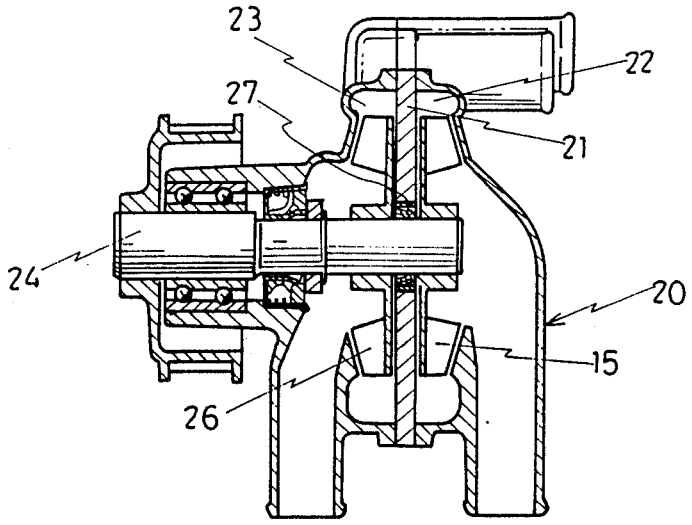
FIG 2 PRIOR ART
FIG. 2 is a view similar to FIG. 1, but showing a conventional water pump device.

Referring now to FIG. 1 showing a water pump device according to the present invention, a housing having first and second housing parts 6 and 7 has an annular partition wall 3 mounted therein. A pump shaft 15 is rotatably supported in the housing part 7 by means of a bearing 16. A mechanical seal 17 is positioned between the housing part 7 and the pump shaft 15. Securely mounted on the pump shaft 15 is a rotor 14 which has a pair of sets of impellers 12 and 13 thereon. First and second separate pump chambers 4 and 5 are defined within the housing and are separated by the rotor 14 and the annular partition wall 3 which extends into the housing to form a planar extension of the rotor. The chamber 4 is in communication with an inlet or suction port 8 and an outlet or discharge port 10 while the chamber 5 is in communication with an inlet or suction port 9 and an outlet or discharge port 11. The impellers 12 and 13 are positioned within the chambers 4 and 5, respectively, so that independent double pump means 1 and 2 are constructed.

The partition wall 3 has an inwardly projecting portion **3*a* and the rotor 14 has an outwardly projecting portion 14*a* which is axially offset from portion 3*a*, i.e., an inner diameter of the partition wall is greater than an outer diameter of the rotor in any axial plane, whereby a labyrinth seal is formed at the annular clearance 18 between the rotor 3 and the partition wall. This clearance 18** is properly set according to the required efficiency of two water cooling systems and permits the partition wall to be fitted on the rotor in the axial direction.

In the case that there is a great difference in temperature between the two water cooling systems, heat insulators may be provided on the partition wall 3 and the rotor 14. The labyrinth seal is of a non-contact type so that the sliding resistance is reduced and the pump efficiency is increased.

While a preferred embodiment of the invention has been described, it will be readily apparent to those skilled in the art that various changes and arrangements can be made to accomplish the objects of the invention without departing from the scope and spirit of the appended claims.

What is claimed as new and desired to be secured by Letters Patent of the United States is:

1. A water pump device comprising:

a pump housing;

a pump shaft rotatably mounted in said housing;

a rotor mounted on said pump shaft;

an annular partition wall mounted on said housing and extending into said housing so as to form a planar extension of said rotor;

means for forming a seal between said partitions wall and said rotor;

wherein said rotor and partition wall define first and second substantially independent pump chambers in said housing, an inner diameter of said partition wall being greater than an outer diameter of said rotor at any axial plane including said partition wall and said rotor, whereby said partition wall may be fitted on the rotor in the axial direction.

2. The pump device of claim 1 where said rotor and said partition wall define an annular clearance therebetween.

3. The pump device of claim 2 wherein said rotor and said partition wall define a labyrinth seal at said annular clearance as said seal forming means.

4. The pump device of claim 3 wherein said labyrinth seal is formed by axially offset projections of said rotor and said partition wall, said projections extending into said annular clearance.

5. The pump device of claim 4 wherein said projections of said partition wall at one axial end of said partition wall have an inner diameter greater than a diameter of the corresponding axial end of said rotor.

* * * * *